US005702299A

United States Patent [19]

Sundholm

[11] Patent Number: 5,702,299

[45] Date of Patent: Dec. 30, 1997

[54] METHOD AND INSTALLATION FOR REMOVING SMOKE FROM A MONITORED SPACE

[76] Inventor: Göran Sundholm, Ilmari Kiannon kuja 3, FIN-04310 Tuusula, Finland

[21] Appl. No.: 535,294

[22] PCT Filed: May 6, 1994

[86] PCT No.: PCT/FI94/00173

§ 371 Date: Nov. 3, 1995

§ 102(e) Date: Nov. 3, 1995

[87] PCT Pub. No.: WO94/26356

PCT Pub. Date: Nov. 24, 1994

[30] Foreign Application Priority Data

May 11, 1993 [FI] Finland ..... 932135

[51] Int. Cl.[6] ..... F24F 6/14

[52] U.S. Cl. ..... 454/342; 169/37; 169/91

[58] Field of Search ..... 454/342, 357; 169/43, 45, 46, 61, 37, 91

[56] References Cited

U.S. PATENT DOCUMENTS

| | | | |
|---|---|---|---|
| 2,436,038 | 2/1948 | Farrell | 454/342 |
| 2,935,135 | 5/1960 | Grant, Jr. | 454/342 |
| 4,765,231 | 8/1988 | Ariello . | |
| 4,779,801 | 10/1988 | O Donnell | 239/276 |
| 4,928,583 | 5/1990 | Taylor et al. . | |
| 4,986,364 | 1/1991 | Clark | 169/48 |
| 5,062,487 | 11/1991 | Siria et al. | 169/91 |

FOREIGN PATENT DOCUMENTS

| | | |
|---|---|---|
| 213136 | 9/1984 | Germany . |
| 2069836 | 9/1991 | United Kingdom . |
| 92/20453 | 11/1992 | WIPO . |
| 93/21997 | 11/1993 | WIPO . |

*Primary Examiner*—Harold Joyce
*Attorney, Agent, or Firm*—Ladas & Parry

[57] ABSTRACT

In a space (1) and an installation for fighting a fire in the space, and further including a shower room (3), a through-wall opening into the shower room from the space and at least one ventilation or air-conditioning duct (5) out-going from the shower room, at least one spray head (11*a*) sprays liquid in the form of small droplets, like a fog, into the ventilation or air-conditioning duct (5) to produce a suction, whereby to draw smoke out of the shower room. A sprinkler (6) in the space is arranged, upon release, to activate a further spray head (8) in the opening to produce a suction from said space, whereby to draw said smoke into the shower room for the ventilation or air-conditioning duct.

7 Claims, 5 Drawing Sheets

METHOD AND INSTALLATION FOR REMOVING SMOKE FROM A MONITORED SPACE

The present invention relates to a method and an installation for fighting fire, in particular for rather large units, such as hotels, passenger ships and various public spaces, e.g. restaurants.

A problem with known sprinkler installations, especially automatically releasable ones, is that they usually are arranged to be released at a certain increased temperature and therefore react too late; smoke generation may have been going on for up to half an hour, with devastating effects. The great majority of victims in various fires are poisoned by smoke.

The object of the invention is to provide a new method and a new installation for fighting fire, which effectively prevent smoke from spreading.

The method according to the invention is mainly characterized by producing, utilizing at least one sprinkler or spray head spraying high pressure liquid in the form of small droplets, like a fog, into an out-going ventilation or air condition duct of said unit, a suction from a monitored space into said out-going ventilation or air condition duct, in order to remove smoke gases from the monitored space.

Existing ventilation and air condition duct do not in general endure heat. An essential advantage of the invention is therefore that the suction for drawing the smoke out is produced by means of fog-like liquid spraying having a good cooling effect.

By a high drive pressure is here meant a range from about 20 bar up to about 300 bar, as compared to some 6–10 bar in conventional sprinkler installations. The droplet size is preferably about 50–150 microns. The sprinklers or spray heads preferably have a plurality of nozzles directed obliquely outwards and mutually adapted in such a way that they together produce a suction concentrated fog-like liquid spray with a good penetration power.

Said at least one sprinkler or spray head is preferably activated, automatically or manually, on the basis of smoke alarm or detection, whereat smoke generated already at an early stage of a fire will be removed and thus decisively prevented from spreading.

In passenger ships and hotels which usually are divided into fire sections with electrically operated section valves, the smoke gases tend to spread especially along corridors. When a smoke alarm signal is received from a fire section, the rest of the section valves are closed, whereafter a signal is given, e.g. after 30 seconds, to a pump unit of the installation or to a drive unit comprising a set of hydraulic accumulators, in order to rise the pressure, e.g. to 100 bar, whereat suction removal of smoke is initiated in the corridors and similar spaces of the fire section in question.

Those sprinklers in corridors, rooms or cabins, or in public spaces like restaurants, which are intended for actual fire extinguishing, are preferably arranged at or in the smoke suction removal openings, whereby the sprinkler release ampoules or other types of temperature sensitive release means are relatively quickly heated to release temperature by the smoke flowing past. In public spaces the smoke suction is preferably initiated at once in the whole space.

In ship cabins the cabin sprinkler is preferably arranged to upon activation distribute liquid to a spray head mounted in an opening in a shower room wall of the cabin, in order to produce a suction from the cabin space into the shower room and further out through that ventilation duct which usually leads out of the shower room.

The invention shall in the following be described in more detail with reference to the attached drawing which, by way of example, shows a number of preferred embodiments.

Figure 1:
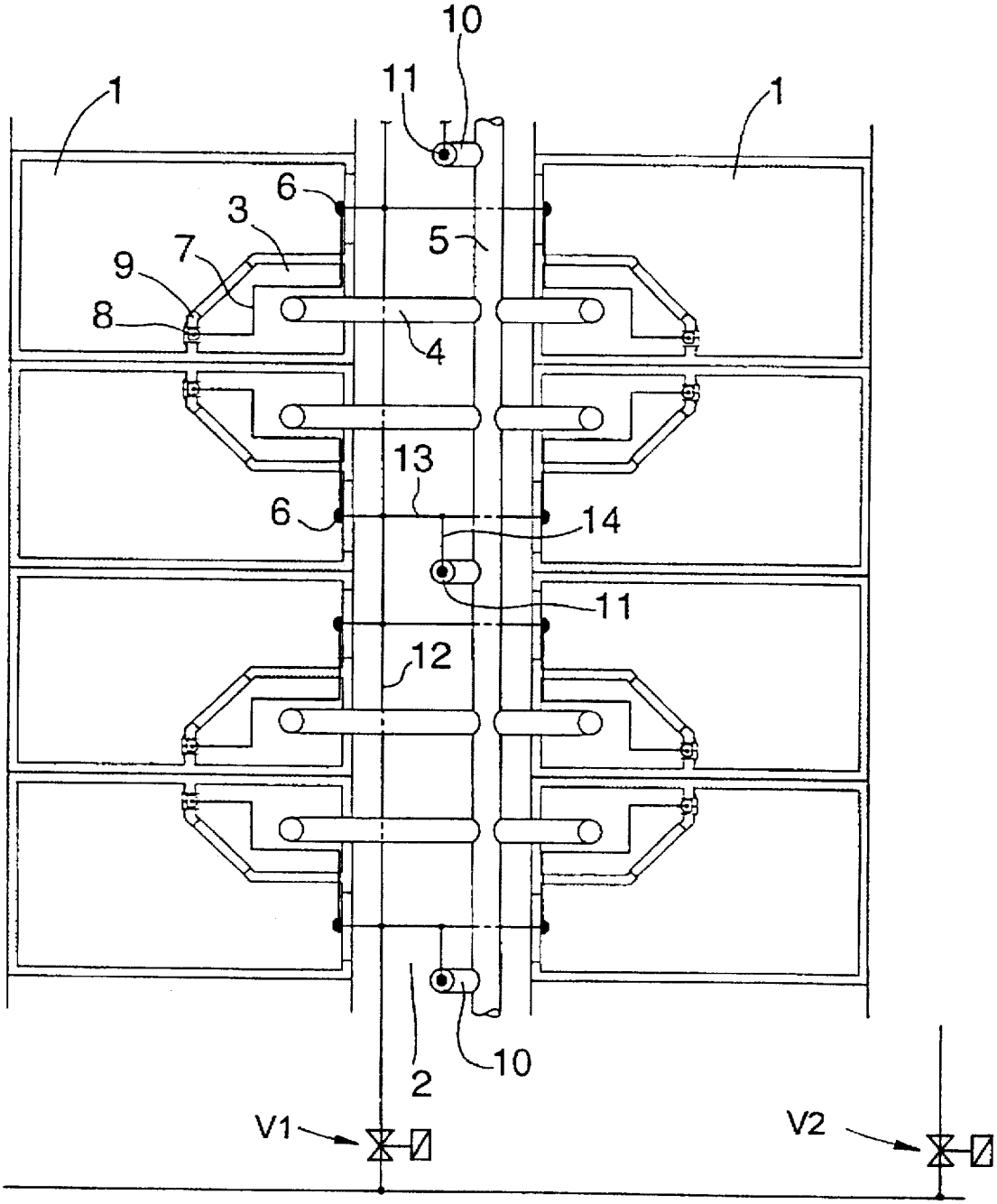
FIG. 1 shows a plan drawing of a block of ship cabins and a corridor.

In FIG. 1 is seen eight ship cabins 1, four on either side of a corridor 2. From the shower or toilet room 3 of each cabin 1 leads a ventilation duct 4 to a collecting duct 5 which runs along the corridor 2 and in which is maintained a certain ventilation suction. In the cabins 1, on the wall above the cabin door, is mounted a sprinkler control device 6 directed into the cabin and arranged to, upon release, or activation, distribute liquid via a branch line 7 to a spray head 8 mounted in a through opening in the wall 9 of the shower room 3 and directed into the shower room.

To the out-going collecting duct 5 running in the direction of the corridor 2 are further joined a number of pipe elements 10. In the respective opening of these, in the corridor ceiling, is provided a preferably double direction sprinkler means 11, a preferable embodiment of which is shown in detail in FIG. 3. A feed line for extinguishing liquid is designated 12. Branchings 13 lead from the feed line to the cabin sprinklers and further branchings 14 lead from the branchings 13 to the respective corridor sprinklers 11. Smoke detectors are preferably provided in each cabin and along the corridor, although not visible in FIG. 1 which is a part of a fire section.

Figure 2:
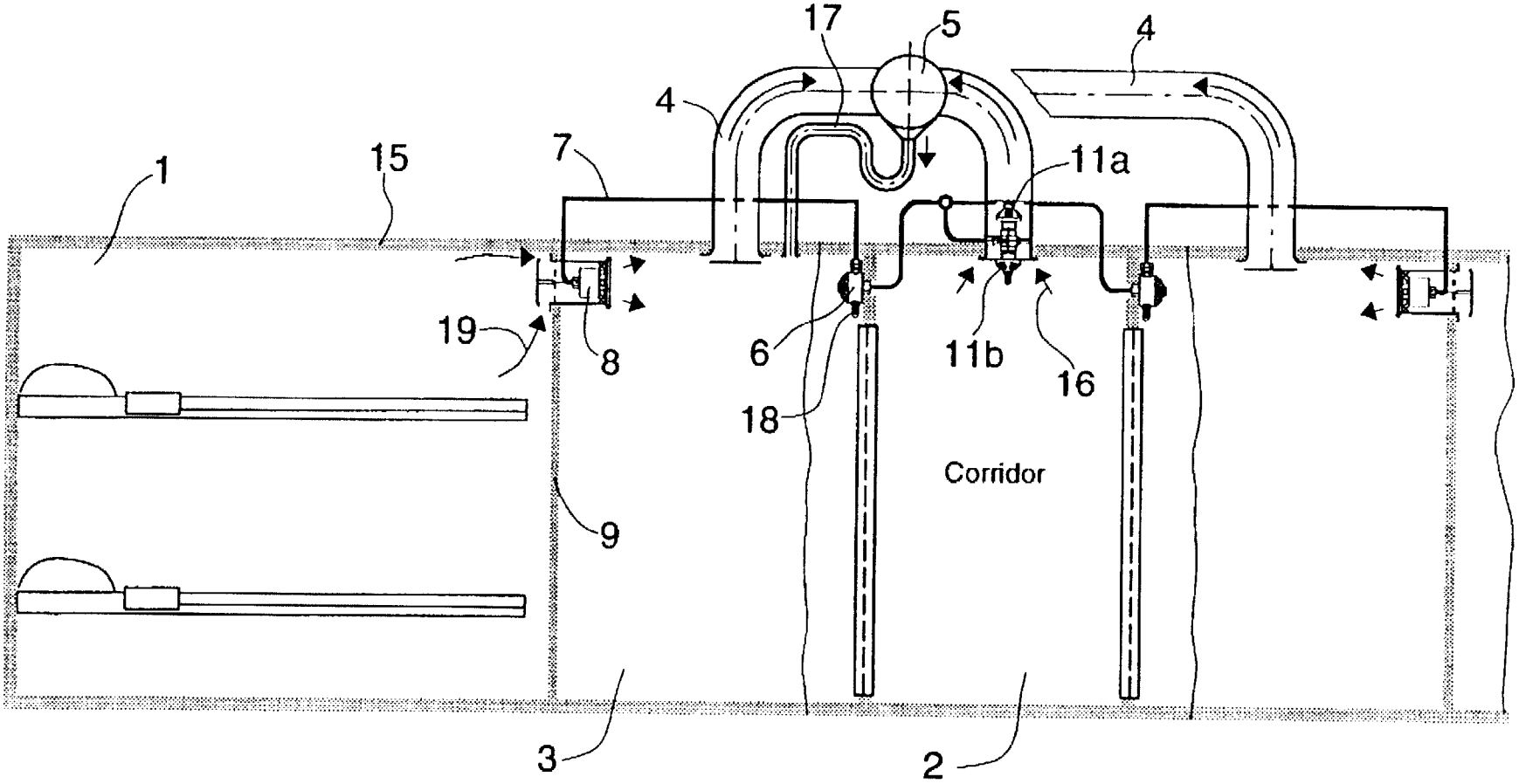
FIG. 2 shows a section of a cabin and of the corridor.

As shown in FIG. 2, the ventilation ducts 4 leading out of the shower rooms 3 of the cabins, as well as the collecting duct 5 along the corridor 2, can be mounted in a passage between a descended ceiling 15 and a higher ceiling. The sprinkler means 11 in the corridor 2 preferably comprise one spray head 11*a* directed upwards into the respective pipe element 10 and one sprinkler 11*b* directed downwards, both being fed in common by a branching 14, as shown in FIG. 1.

The general operation of the installation shall in the following be described with reference to FIGS. 1 and 2; some details shall later be described with reference to FIG. 3.

When the installation is in a state of stand-by, a liquid pressure of e.g. 16 bar can be assumed in the line systems 12, 13, 14 of all fire sections. The suction spray heads 11*a* directed into the pipe elements 10 and further into the collecting duct 5 are arranged to be activated at a somewhat higher pressure, e.g. 20 bar. When the fire central receives a smoke alarm signal from one fire section, the section valves V2 of the rest of the fire sections are automatically closed; only the section valve V1 of the alarming section remains open. After a certain delay, e.g. 30 seconds, the fire central gives a signal to a pump unit, or alternatively to a drive unit including a set of hydraulic accumulators, to increase the liquid pressure in the line system 12, 13, 14 of the relevant fire section to e.g. 100 bar. All corridor spray heads 11*a* of the fire section are then activated and suck smoke from the corridors 2 to the collecting duct 5, as indicated by arrows 16 in FIG. 2. A major part of the liquid sprayed into the duct 5 collects on the bottom of the duct and can be drained to the shower rooms of the respective cabins via ducts 17.

The cabin sprinklers 6 and the corridor sprinklers 11*b* intended for actual fire extinguishing are pressure balanced and are therefore not released by the high pressure alone at this stage. If a cabin sprinkler 6 is released because its release ampoule 18 or similar has reached release temperature, the released cabin sprinkler 6 distributes liquid via its branching 7 to the respective spray head 8 mounted in the shower room wall 9 of the cabin and directed into the shower room 3. By spraying liquid into the shower room, the spray head 8 produces a suction drawing smoke out of the cabin 1 into the shower room 3, as indicated by arrows 19 in FIG. 2, and further out through the ducts 4 and 5. If a corridor sprinkler **11*b* is released in the same way because of increased temperature, the suction of smoke is interrupted at that particular corridor sprinkler 11*b*** but smoke is continued to be sucked out through the other suction points in the corridors within the fire section.

Figure 3:
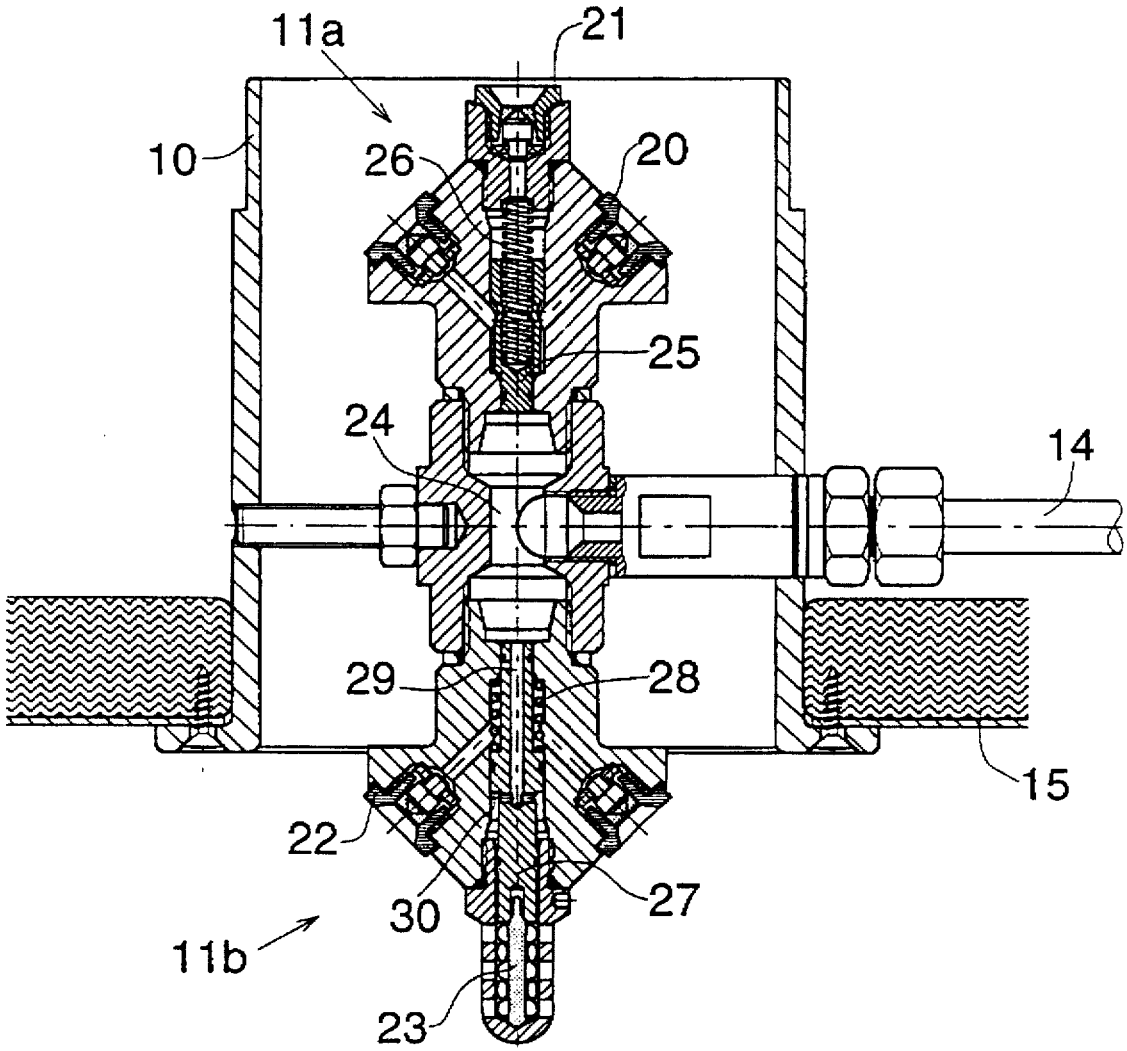
FIG. 3 shows a section of a corridor sprinkler.

FIG. 3 shows a preferred embodiment of a corridor sprinkler. A spray head **11*a* directed upwards into the pipe element 10 has a number of nozzles 20 directed obliquely outwards and a central nozzle 21. The sprinkler 11*b* directed down into the corridor 2 has nozzles 22 directed obliquely outwards, and a release element 23**, such as a glass ampoule.

The spray head **11*a* and the sprinkler 11*b* have in common an inlet chamber 24 receiving liquid from the line 14. In stand-by state, FIG. 3, the pressure in the chamber 24 is e.g. 16 bar. This pressure is not capable of driving a spindle 25, in the spray head 11*a*, upwards against a spring 26 the force of which is adapted to be overcome by a higher pressure, e.g. 20 bar. As the liquid pressure after a smoke alarm rises to e.g. 100 bar the spindle 25 strikes up and frees connections for liquid to the nozzles 20 and 21**.

The sprinkler **11*b* likewise comprises a spindle 27 which forced by a spring 28 lies against the release ampoule 23. An axial channel 29 runs from the inlet chamber 24 through the spindle to an annular space between the spindle 27 and the surrounding sprinkler housing, said annular space having an end face 30 formed by the spindle and having an area equal to that end face of the spindle at the inlet chamber 24 which is subjected to the pressure in the chamber 24. That pressure of the inlet chamber 24 which acts on the end of the spindle 27 is thus balanced by the end face 30 of said annular space, so that regardless of the magnitude of the pressure in the inlet chamber 24, e.g. 100 bar releasing the spray head 11*a*, the spindle 27 is forced against the release element 23 by the force of the spring 28 only. The release element 23 withstands this force at normal temperature. When the release element melts or breaks at an increased temperature the spring 28 strikes the spindle 27 down and the connections to the nozzles 22** are opened.

The cabin sprinklers 6 are preferably in principle like the sprinkler **11*b*; one of the nozzles or an additional connection arranged in the same way can via the line 7 be connected to the spray head 8 in the wall 9** of the shower room.

Regarding the detailed structure and function of the sprinklers 6, 11 and the spray heads reference is made to the international patent applications PCT/FI92/00060, PCT/FI92/00155 and PCT/FI92/00193.

Figure 4:
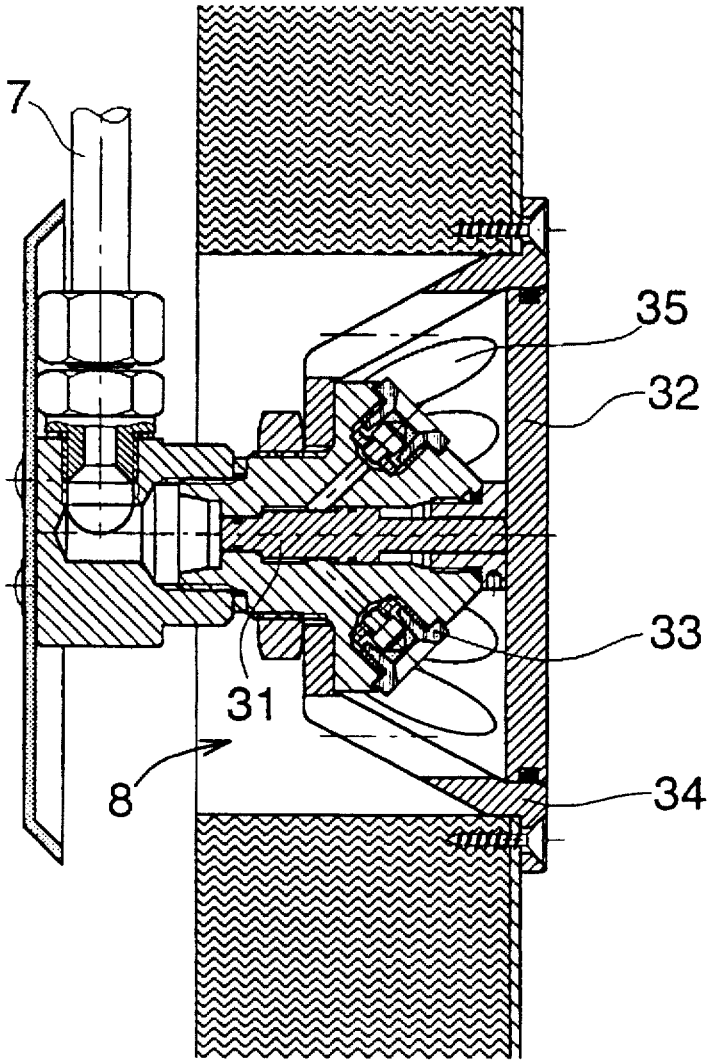
FIG. 4 shows a section of a spray head in a wall of a shower room.

The spray head 8 in the wall 9 of the shower room comprises a central spindle 31 which under the influence of the liquid pressure in the feed line 7, upon connection by the cabin sprinkler 6, strikes to the right in FIG. 4 and thereby presses off a cover 32 and opens connections to the nozzles 33. These nozzles produce a suction from the cabin through apertures 35 in the sprinkler holder 34 into the shower room and further out.

Figure 5:
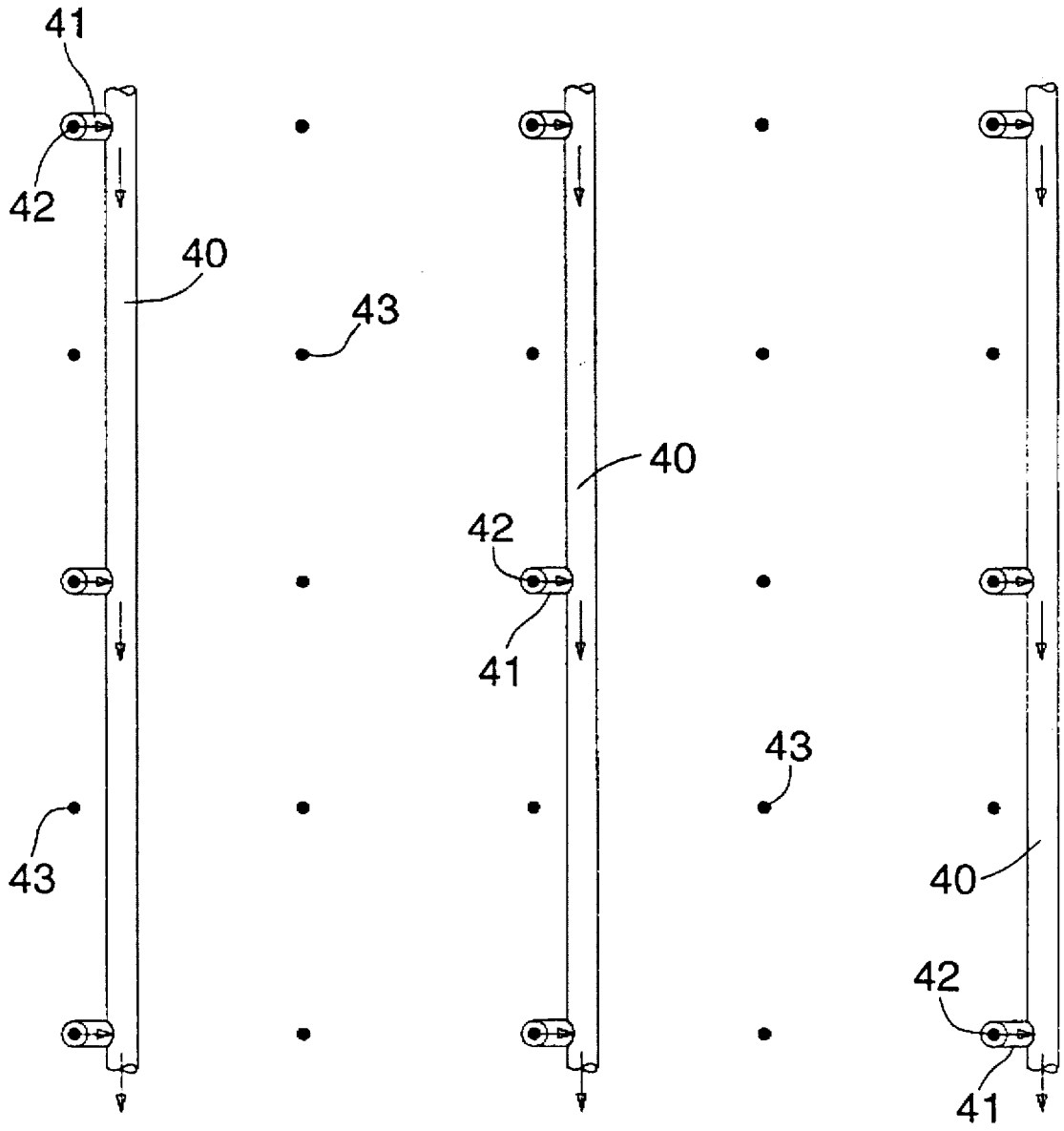
FIG. 5 shows an application of the invention in a larger space.

FIG. 5 illustrates an application of the invention for a larger space or for a part thereof, e.g. a restaurant. A number of out-going ventilation ducts, preferably in or at the ceiling, are designated 40, a number of pipe elements from the space to the ventilation ducts 40 are designated 41 and double direction sprinkler means mounted in these pipe elements are designated 42, corresponding to numerals 5, 10 and 11 in FIG. 1. A number of sprinklers comparable to the cabin sprinklers 6 in FIGS. 1 and 2 are designated 43. If desired, the sprinklers 43 can be arranged to upon release also activate neighbouring sprinklers or spray heads, e.g. according to the same principle as for the combination sprinkler 6—spray head 8 in FIGS. 1 and 2.

The installation works in principle in the same way as earlier has been described with reference to FIGS. 1–3, preferably in such a way that all suction points 41 are activated at the first smoke alarm.

The invention has in the foregoing been described in connection with an installation including means for actual fire extinguishing. The invention can, however, also be used independently for smoke removal, e.g. as a complement in existing buildings which already have some kind of fire fighting installation. The smoke removal can then be made to work without a connection to the rest of the fire fighting installation, although not necessarily. It is even possible to contemplate embodiments with smoke removal only, without sprinkler means for actual fire extinguishing.

I claim:

1. In a method for fighting a fire in a space with a ventilation or air-conditioning duct out-going therefrom, the space being divided into fire sections with section valves, the improvement of said method comprising:

closing all of said section valves except one relating to a smoke alarm signal; and after a predetermined delay therefrom, signaling a fire-fighting drive unit for spraying high pressure liquid in the form of small droplets, like a fog, from at least one sprinkler or spray head into said ventilation or air-conditioning duct to produce a suction from said space into said ventilation or air-conditioning duct, whereby to remove smoke gases from said space.

2. In a space (1) and an installation for fighting a fire in said space, and further including a shower room (3), a through-wall opening into said shower room from said space and at least one ventilation or air-conditioning duct (5) out-going from said shower room, the improvement of said installation comprising:

at least one spray head (**11*a*) for spraying liquid in the form of small droplets, like a fog, into said ventilation or air-conditioning duct (5) to produce a suction, whereby to draw smoke into said ventilation or air-conditioning duct from said space; and a sprinkler control device (6) in said space and arranged to, upon release, to activate a further spray head (8**) in said opening to produce a suction from said space past said further spray head, whereby to draw smoke into said shower room for removal by said ventilation or air-conditioning duct.

3. Installation according to claim 2, wherein said at least one spray head (**11*a***) is arranged to be activated on the basis of smoke indication.

4. Installation according to claim 2, and further comprising a further sprinkler (**11*b*) in combination with said at least one spray head, directed oppositely with respect to said at least one spray head and pressure balanced therewith by having a liquid feed (14**) in common with said at least one spray head.

5. In a space (1) and an installation for fighting a fire in said space, and further including a toilet room (3), a through-wall opening into said toilet room from said space and at least one ventilation or air-conditioning duct (5) out-going from said toilet room, the improvement of said installation comprising:

at least one spray head (11*a*) for spraying liquid in the form of small droplets, like a fog, into said ventilation or air-conditioning duct (5) to produce a suction, whereby to draw smoke into said ventilation or air-conditioning duct from said space; and a sprinkler (6) in said space arranged, upon release, to activate a further spray head (8) in said opening to produce a suction from said space past said further spray head, whereby to draw smoke into said toilet room for removal by said ventilation or air-conditioning duct.

6. Installation according to claim 5, wherein said at least one spray head (11*a*) is arranged to be activated on the basis of smoke indication.

7. Installation according to claim 5, and further comprising a further sprinkler (11*b*) in combination with said at least one spray head, directed oppositely with respect to said at least one spray head and pressure balanced therewith by having a liquid feed (14) in common with said at least one spray head.

* * * * *